US006311501B1

(12) United States Patent
Allison et al.

(10) Patent No.: US 6,311,501 B1
(45) Date of Patent: Nov. 6, 2001

(54) ICE MACHINE WATER DISTRIBUTION AND CLEANING SYSTEM AND METHOD

(75) Inventors: Matthew W. Allison, Mundelein; Christopher Salatino, Arlington Heights, both of IL (US)

(73) Assignee: Scotsman Ice Systems, Vernon Hills, IL (US)

( * ) Notice: Subject to any disclaimer, the term of this patent is extended or adjusted under 35 U.S.C. 154(b) by 0 days.

(21) Appl. No.: 09/709,135

(22) Filed: Nov. 9, 2000

Related U.S. Application Data

(60) Provisional application No. 60/164,787, filed on Nov. 11, 1999.

(51) Int. Cl.[7] ..... F25C 1/00

(52) U.S. Cl. ..... 62/74; 62/303; 62/347

(58) Field of Search ..... 62/303, 66, 74, 62/347

(56) References Cited

U.S. PATENT DOCUMENTS

| | | | | |
|---|---|---|---|---|
| 5,237,837 | | 8/1993 | Naruse et al. | 62/434 |
| 5,479,707 | * | 1/1996 | Alvarez et al. | 29/890.039 |
| 5,752,393 | * | 5/1998 | Schlosser et al. | 62/303 |
| 5,829,257 | * | 11/1998 | Newman et al. | 62/73 |
| 5,941,091 | * | 8/1999 | Broadbent | 62/347 |

* cited by examiner

*Primary Examiner*—William E. Tapolcai
*Assistant Examiner*—Mohammad M. Ali
(74) *Attorney, Agent, or Firm*—Ohlandt, Greeley, Ruggiero & Perle, LLP

(57) ABSTRACT

An ice making machine having a water distribution and cleaning system which supplies an evaporator plate assembly with all of the water required during ice making operations and provides all of a cleaning solution to cascade down interior and exterior surfaces of the evaporator plate assembly during a cleaning operation.

15 Claims, 4 Drawing Sheets

ICE MACHINE WATER DISTRIBUTION AND CLEANING SYSTEM AND METHOD

This Application claims the benefit of U.S. Provisional Application No. 60/164,787, filed on Nov. 11, 1999.

BACKGROUND OF THE INVENTION

1. Technical Field

The present invention relates generally to an apparatus for manufacturing ice. More particularly, the present invention relates to a unique construction for a water distribution and cleaning system for use in the apparatus for manufacturing ice and a method for cleaning an evaporator assembly thereof.

2. Discussion

Automatic ice making machines are commonplace. These ice making machines are found in food and drink service establishments, hotels, motels, sports arenas and various other places where large quantities of ice are needed on a continuous basis. Some of these ice making machines produce flaked ice while others produce ice shaped in a variety of configurations which are generally referred to as cubes. The present invention relates to an ice making machine that produces ice which is shaped in one of these various configurations or cubes.

Automatic ice manufacturing machines generally include a refrigeration system having a compressor, a condenser and an evaporator; a series of individual ice forming locations which may or may not be referred to as pockets; and a water supply system. In a typical ice manufacturing machine the evaporator section of the refrigeration system is connected to the series of individual ice forming locations so that these individual ice forming locations are directly cooled by the refrigeration system. Water may either be supplied to fill these ice forming locations if they are in the form of a series of pockets or water may be supplied to these ice forming locations by having the water trickle over or be sprayed onto the individual ice forming locations. The run-off of this trickled or sprayed water is usually recirculated within the water supply. The trickling or spraying methods of supplying water is normally preferred because these methods will produce clear ice while the static filled pockets method generally will produce white ice.

Automatic ice making machines are normally controlled by the level of supply of the ice in the storage portion of the ice making machine. When the supply of ice in the storage portion is insufficient, automatic controls cycle the ice making machine through ice production and ice harvest modes to supplement the supply of ice in the storage portion. In the production mode, the refrigeration system operates in a normal manner such that expanding refrigerant in the evaporator removes heat from the series of ice forming locations, freezing the water to form an ever growing layer of ice. When the ice thickness reaches a predetermined condition or a specified time period has elapsed, the ice making machine switches to harvest mode. Typically, the harvest mode involves a valve change which directs hot refrigerant gasses to the evaporator. The ice forming locations are heated by the hot refrigerant gases until the ice in contact with the evaporator begins to thaw. Normally some type of mechanism ensures that a vacuum is not formed between the individual ice pieces and the evaporator which normally involves the introduction of air between the individual ice pieces and the evaporator surface. Once the ice eventually falls from the evaporator, the valving on the refrigeration system is changed back to its original configuration, the production mode, and thus the cycle begins again. The ice making machine continues to cycle between the production mode and the harvest mode until some type of sensing system in the storage portion signals the refrigeration system to pause. Thereafter, when the cleaning cycle is desired, it may be manually initiated.

Current automatic ice making machines utilize a cleaning method where only a portion of the cleaning solution passes down the interior and exterior of the evaporator. Such cleaning methods allow for only a portion of the cleaning solution to be delivered to all of the surfaces of the evaporator. These cleaning methods supply cleaning solution at a relatively low pressure and velocity, thereby decreasing the cleaning capabilities of the system. For example, the cleaning system described in U.S. Pat. No. 5,237,837 applies cleaning fluid to the vertical ice forming channels of an ice forming plate and to a space behind the plate, but does not apply the cleaning fluid to partitions that form the sides of the ice forming channels. Automatic ice making machines utilizing such cleaning methods have performed satisfactorily but they are relatively inefficient.

Moreover, some current automatic ice making machines utilize a microprocessor or controller which is required to perform all the necessary functions for the ice making and cleaning cycles, plus those associated with the refrigeration system that supplies cooling and heating. Such systems require numerous manual operations which decreases the efficiency of the system. Additionally, the maintenance expense relative to these types of systems is rather costly.

In order to overcome the problems associated with automatic ice making machines wherein only a portion of the cleaning solution passes down the interior and exterior of the evaporator, and requiring numerous manual controller operations, various designs of water distribution and cleaning systems have been developed. The continued development of such water distribution and cleaning systems has been directed to designs which simplify the manufacturing process and the assembly of the systems while keeping costs at a minimum and overall performance efficiency at a maximum.

SUMMARY OF THE INVENTION

It is a principal object of the present invention to provide an ice machine water distribution and cleaning system which supplies an evaporator with the necessary amount of water required for the ice making operation and supplies cleaning solution to all of the exposed surfaces of the evaporator during the cleaning operation.

A related object of the present invention to provide an ice machine water distribution and cleaning system which allows water to be circulated down the exterior surfaces of an evaporator assembly, while cooling and heating is provided to the internal surfaces of the evaporator assembly, the internal surfaces of the evaporator assembly are not sealed and are exposed to all water used for ice making.

It is another object of the present invention to provide an ice machine water distribution and cleaning system which allows all of the cleaning solution to pass down the interior of the evaporator for a set period of time, thereafter switching the direction of the cleaning solution flow and passing all of the cleaning solution down the exterior of the evaporator.

It is still yet another object of the present invention to provide an ice machine water distribution and cleaning system which allows the cleaning solution to be delivered to all of the surfaces of an evaporator at a high pressure and velocity.

The foregoing objects are accomplished by the ice making machine of the present invention that comprises an evaporator assembly, a fluid source, a pump, first and second fluid distributors and a valve. The evaporator assembly includes a plate that has a first side and an opposed side. A plurality of partitions extend outwardly from the first side in spaced apart relation to form a plurality of ice forming channels therebetween. An evaporator tubing is disposed on the opposed side of the plate. The pump is operable to pump fluid from the fluid source to the valve. The valve has a first mode in which the fluid is diverted to the first fluid distributor, which is located above the evaporator assembly to supply the fluid to the ice forming channels. The valve has a second mode in which the fluid is diverted to the second fluid distributor, which is located above the evaporator assembly to supply the fluid to the partitions. When the fluid contains a cleaning solution, the ice making channels are cleaned when the valve is in the first mode and the partitions are cleaned when the valve is in the second mode. Thus, all of the evaporator surfaces that contact the ice during ice making operations are cleaned during a cleaning operation.

According to one aspect of the invention, the evaporator plate assembly includes a stamped stainless steel evaporator which is manufactured from two formed sheets of stainless steel, and a formed and flattened or round serpentine shaped copper tube. The two formed stainless steel sheets form the outer walls of the evaporator. The partitions are integrally formed to the outside surface of the evaporator in order to form ice forming channels.

According to the method of the invention, a cleaning fluid is cascaded down the channels. The cleaning fluid is also cascaded down the partitions. Preferably, the fluid is sequentially cascaded down the channels and the partitions.

Other advantages, benefits and objects of the present invention will become apparent to those skilled in the art from a reading of the subsequent detailed description, appended claims and accompanying drawings.

BRIEF DESCRIPTION OF THE DRAWINGS

In the drawings which illustrate the best mode presently contemplated for carrying out the invention.

DETAILED DESCRIPTION OF THE PREFERRED EMBODIMENT

Figure 1:
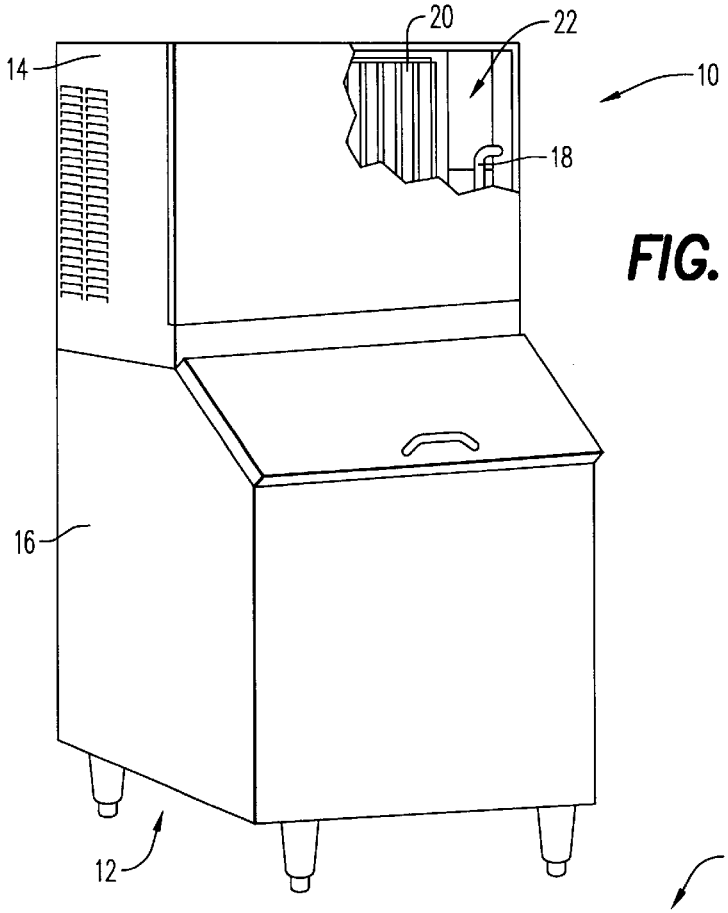
FIG. 1 is a perspective view of an automatic ice making machine incorporating the unique ice machine water distribution and cleaning system in accordance with the present invention.

Referring now to the drawings in which like reference numerals designate like or corresponding parts throughout the several views, there is shown in FIG. 1 an automatic ice making machine incorporating the unique ice machine water distribution and cleaning system in accordance with the present invention which is designated generally by the reference numeral 10. The automatic ice making machine 10 includes a housing 12 which defines a refrigeration section 14 and a storage section 16. A refrigeration system 18 is disposed within the refrigeration section 14 and includes a compressor (not shown, but commonly known), a condenser (not shown, but commonly known), an evaporator plate assembly 20, and a water distribution and cleaning system 22. The refrigeration system 18 operates in a production mode to expand refrigerant in the evaporator plate assembly 20 to remove heat from water supplied to the surface of the evaporator plate assembly 20 in order to freeze the water to create ice pieces as is well known in the art. When the ice pieces reach a predetermined size and/or after a predetermined time period, the ice making machine 10 switches from the above described production mode to a harvest mode to release the ice pieces from the evaporator plate assembly 20 and store them in the storage section 16. After completion of the harvest mode, the ice making machine 10 switches back to the production mode. This sequence will continue until a sensor (not shown, but commonly known) indicates that the storage section 16 contains a sufficient quantity of ice. Thereafter, when the cleaning cycle is desired, it may be manually initiated.

Referring now to FIGS. 2–5, the evaporator plate assembly 20 is shown including a first side plate 24, a second side plate 26 and a tube 28. The first side plate 24 is preferably formed from stainless steel. Integrally formed in the first side plate 24 are numerous vertical partitions 30. The second side plate 26 is also preferably formed from stainless steel. Similarly, integrally formed in the second side plate 26 are numerous vertical partitions 32. The vertical partitions 30 and 32 extend over the entire length and width of the first side plate 24 and the second side plate 26. The geometry of the first side plate 24 and the second side plate 26 promotes the formation of ice pieces in distinctive shapes.

Figure 2:
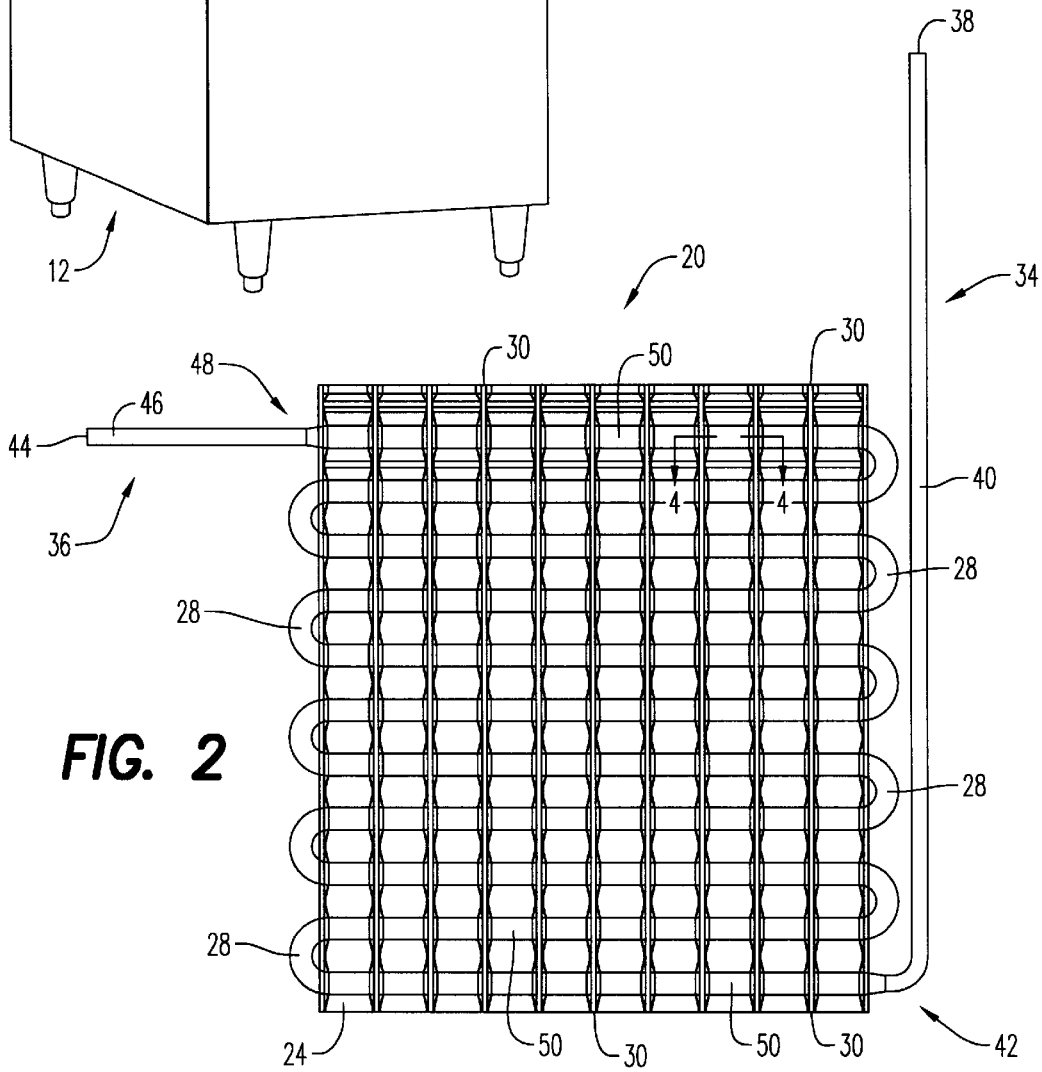
FIG. 2 is an elevational view of the evaporator plate assembly shown in FIG. 1.
Figure 3:
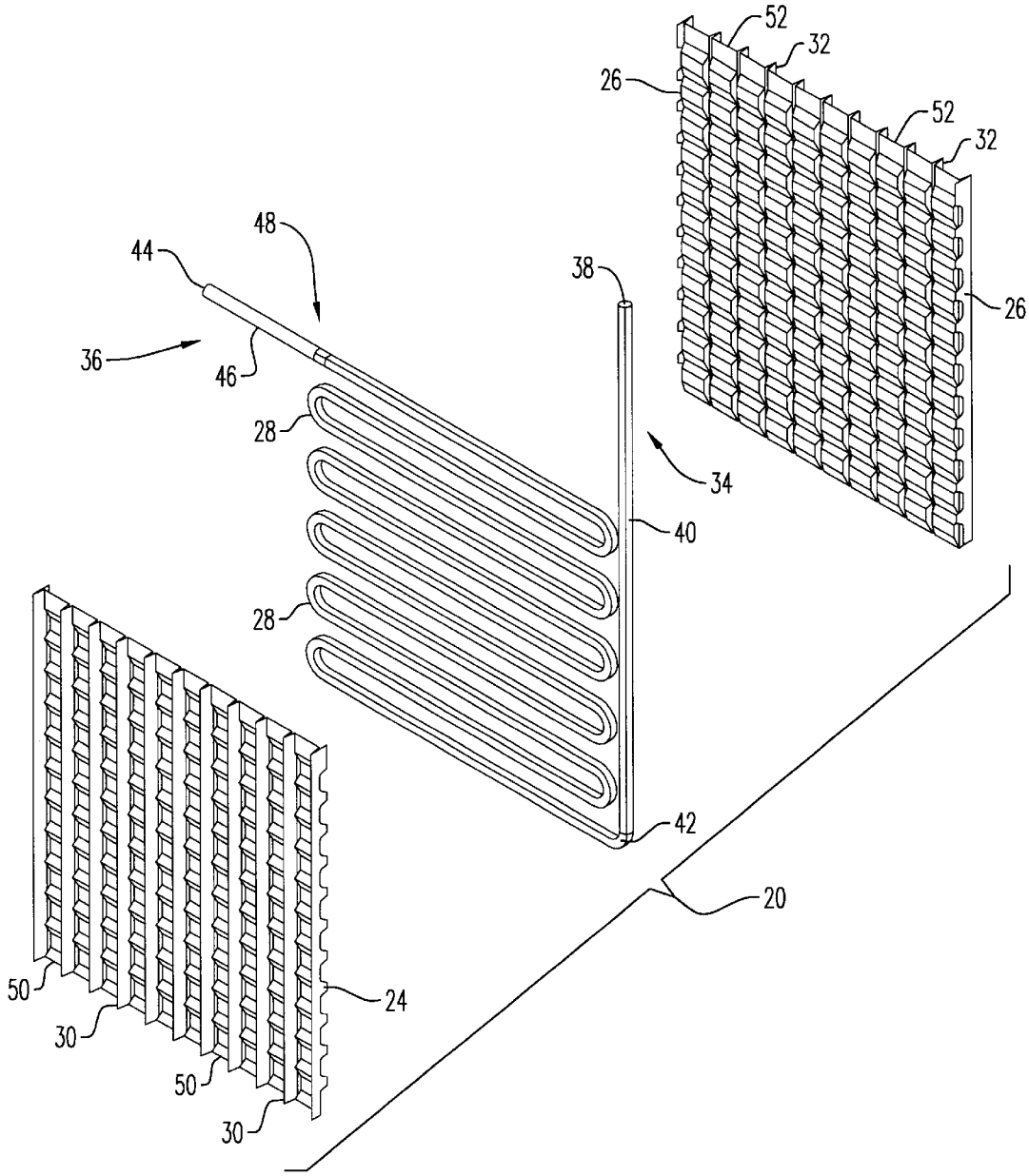
FIG. 3 is an exploded view of the evaporator plate assembly shown in FIG. 2.
Figure 4:
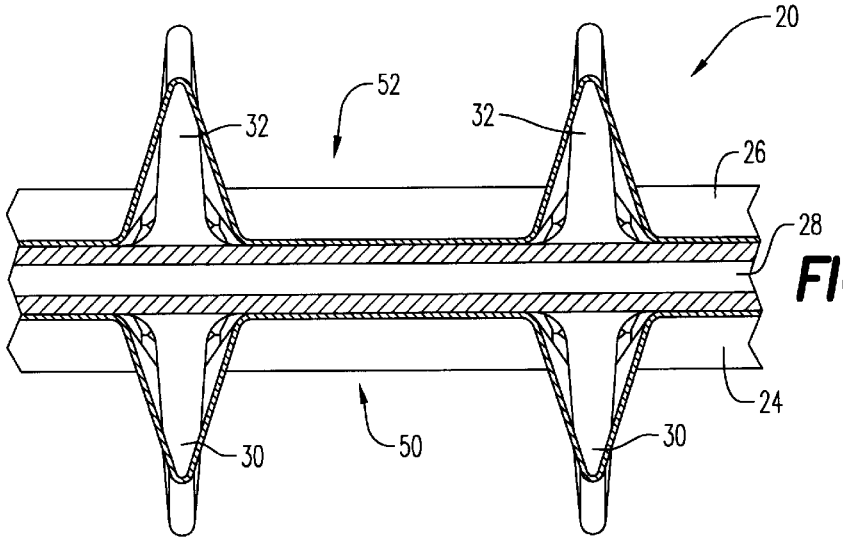
FIG. 4 is a cross-sectional view taken in the direction of arrows 4—4 shown in FIG. 2.
Figure 5:
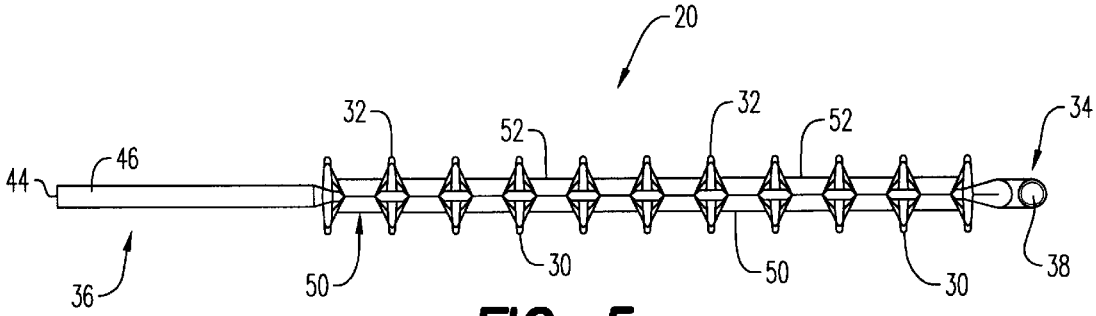
FIG. 5 is a top view of the evaporator plate assembly shown in FIG. 2.

The tube 28 is serpentine in shape, may be flattened or round, and preferably manufactured from copper. As shown in FIGS. 2–4, the tube 28 which is serpentine in shape is sandwiched between the first side plate 24 and the second side plate 26. As illustrated, the tube 28 extends over the entire length and width of the first side plate 24 and the second side plate 26. The tube 28 also includes a refrigerant inlet portion 34 and a refrigerant outlet portion 36. The refrigerant inlet portion 34 includes an inlet 38 and an extension 40. As illustrated in FIGS. 2 and 3, the extension 40 of the refrigerant inlet portion 34 is in fluid communication with the tube 28 at a lower portion 42 of the tube 28. The refrigerant outlet portion 36 includes an outlet 44 and an extension 46. As illustrated in FIGS. 2 and 3, the extension 46 of the refrigerant outlet portion 36 is in fluid communication with the tube 28 at an upper portion 48 of the tube 28. The National Sanitation Foundation (NSF) requires that there be no exposed copper in the food zone. Thus, the tube 28 which is serpentine in shape, flattened or round, and preferably manufactured from copper is therefore plated with nickel or some similar material prior to assembly.

During assembly, the first side plate 24 and the second side plate 26 are bonded to the tube 28 which has previously been plated with nickel or some similar material. The first side plate 24 and the second side plate 26 are bonded to the tube 28 through any commonly known bonding process. One such known bonding process is disclosed in an application entitled "Evaporator Plate Assembly For Use In A Machine For Producing Ice", Ser. No. 09/328,577, which is commonly owned and incorporated herein by reference. Additionally, the first side plate 24, the second side plate 26 and the tube 28 are assembled so that ice pieces may be made on both sides of the tube 28 which is serpentine in shape and may be flattened or round.

The vertical partitions 30, integrally formed on the first side plate 24, are spaced so as to form numerous channels 50. The vertical partitions 32, integrally formed on the second side plate 26, are similarly spaced as to form numerous channels 52. The channels 50 on the first side plate 24 and the channels 52 on the second side plate 26 define the specific locations for the formation of ice pieces.

Figure 6:
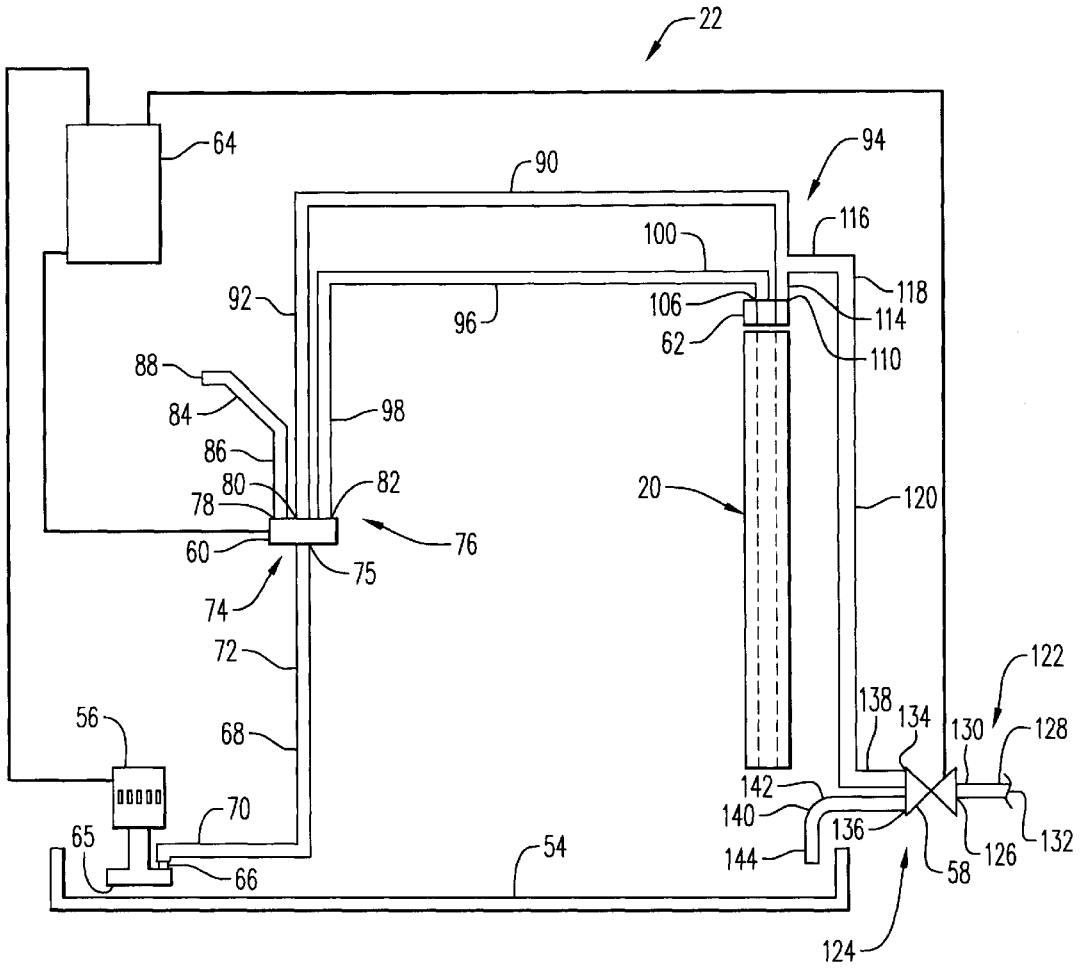
FIG. 6 is a simplified view of the ice machine water distribution and cleaning system in accordance with the present invention.

Referring now to FIG. 6, the water distribution and cleaning system 22 is shown. The water distribution and cleaning system 22 includes a water sump 54, a water pump 56, a dual outlet water inlet valve 58, a four-way water diverter valve 60, a water distribution manifold 62 and a microprocessor or controller 64. The water sump 54 and the water pump 56 are similar to those commonly known in the industry. The water sump 54 contains liquid and is in fluid communication with the water pump 56. The water pump 56 includes an inlet portion 65, an outlet portion or port 66 and a water pump line 68. The water pump line 68 includes a first end 70 and a second end 72. The first end 70 of the water pump line 68 is connected to the outlet portion or port 66 of the water pump 56. The second end 72 of the water pump line 68 is connected to the four-way water diverter valve 60 at an inlet portion 74. The inlet portion 74 of the four-way water diverter valve 60 includes a single inlet port 75. The four-way water diverter valve 60 also includes an outlet portion 76. The outlet portion 76 of the four-way water diverter valve 60 includes three separate outlet ports 78, 80 and 82.

As is further illustrated in FIG. 6, the water distribution and cleaning system 22 also includes a drain line 84 having a first end 86 and a second end 88, a clean water line 90 having a first end 92 and a second end 94, and a freeze water line 96 having a first end 98 and a second end 100. The first end 86 of the drain line 84 is connected to the outlet port 78 of the four-way water diverter valve 60. The second end 88 of the drain line 84 is connected to a drain (not shown). The first end 92 of the clean water line 90 is connected to the outlet port 80 of the four-way water diverter valve 60. The first end 98 of the freeze water line 96 is connected to the outlet port 82 of the four-way water diverter valve 60.

Figure 7:
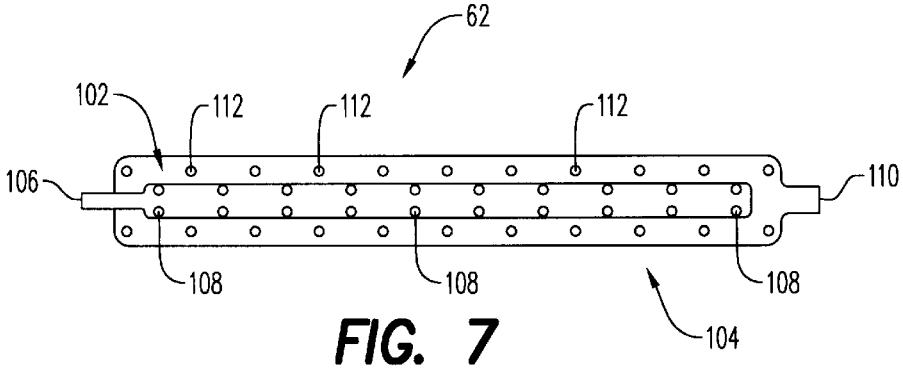
FIG. 7 is a top view of a water distribution manifold in accordance with the present invention.

With continued reference to FIG. 6, and additional reference to FIG. 7, the water distribution manifold 62 is located above and adjacent to the evaporator plate assembly 20. The water distribution manifold 62 includes a freeze water portion 102 and a harvest water portion 104. The freeze water portion 102 of the water distribution manifold 62 includes a freeze water inlet 106 and a series of exit holes 108 which are located around the outer perimeter of the freeze water portion 102. The harvest water portion 104 of the water distribution manifold 62 includes a harvest water inlet 110 and a series of exit holes 112 which are located around the outer perimeter of the harvest water portion 104.

The exit holes 108 of the freeze water portion 102 are aligned over the evaporator plate assembly 20 in such a manner that liquid is allowed to flow from the exit holes 108 and cascade down the channels 50 on the first side plate 24 and the channels 52 on the second side plate 26. Similarly, the exit holes 112 of the harvest water portion 104 are aligned over the evaporator plate assembly 20 in such a manner that liquid is allowed to flow from the exit holes 112 and cascade down the vertical partitions 30 of the first side plate 24 and the vertical partitions 32 of the second side plate 26. Accordingly, the second end 100 of the freeze water line 96 is connected to the freeze water inlet 106 of the freeze water portion 102 of the water distribution manifold 62.

The second end 94 of the clean water line 90 is T-shaped wherein a first leg 114 is connected to the harvest water inlet 110 of the harvest water portion 104 of the water distribution manifold 62 and a second leg 116 is connected to a second end 118 of a dual outlet water inlet valve line 120.

The dual outlet water inlet valve 58 includes an inlet portion 122 and an outlet portion 124. The inlet portion 122 of the dual outlet water inlet valve 58 includes an inlet port 126. An external water supply line 128 includes a first end 130 and a second end 132. The first end 130 of the external water supply line 128 is connected to the inlet port 126 of the dual outlet water inlet valve 58. The second end 132 of the external water supply line 128 is connected to an external water supply (not shown). The outlet portion 124 of the dual outlet water inlet valve 58 includes outlet ports 134 and 136. A first end 138 of the dual outlet water inlet valve 120 is connected to the outlet port 134 of the dual outlet water inlet valve 58. Also attached to the dual outlet water inlet valve 58 is a water sump supply line 140 having a first end 142 and a second end 144. The first end 142 of the water sump supply line 140 is connected to the outlet port 136 of the dual outlet water inlet valve 58. The second end 144 of the water sump supply line 140 is located adjacent the water sump 54.

In general, during operation, the tube 28 is connected to the refrigeration system 18 that will provide the cooling and heating needed to make ice and drop the ice into the storage section 16. The process of making and releasing ice from the evaporator plate assembly 20 will be referred to as the freeze cycle and the harvest cycle, respectively. Refrigerant passes through the tube 28 during the freeze cycle, providing cooling to the first side plate 24 and the second side plate 26. Water is circulated from the water sump 54 and cascades down the exterior surfaces of the first side plate 24 and the second side plate 26. When the first side plate 24 and the second side plate 26 cool down below freezing, the water forms ice on the evaporator plate assembly 20. The exterior surface of the first side plate 24 and the second side plate 26 need to be warmed during the harvest cycle so the formed ice cubes will fall from the evaporator plate assembly 20. Heated refrigerant passes through the tube 28 during the harvest cycle. Fresh water from an external source is directed down the internal surfaces of the first side plate 24 and the second side plate 26. The fresh water assists in warming the surfaces of the first side plate 24 and the second side plate 26 that are not in direct contact with the tube 28.

Specifically, during operation, the water distribution and cleaning system 22 performs all the necessary functions required for the ice making and cleaning cycles only and does not consider the refrigeration system that supplies cooling and heating. Accordingly, the ice making cycle consists of two operations. The first operation, which will be referred to as "freeze", consists of forming ice on the channels 50 of the first side plate 24 and the channels 52 on the second side plate 26 of the evaporator plate assembly 20. The second operation, which will be referred to as "harvest", consists of removing the ice formed on the evaporator plate assembly 20 during freeze.

At the beginning of the freeze cycle, the microprocessor or controller 64 energizes the water pump 56 and the dual outlet water inlet valve 58. Water from an external water supply (not shown) flows through the second end 132 and the first end 130 of the external water supply line 128 into the inlet port 126 of the dual outlet water inlet valve 58. The water from the external water supply (not shown) then flows through the outlet port 136 of the dual outlet water inlet valve 58, through the first end 142 of the water supply line 140 and exits from the second end 144 of the water sump supply line 140 directly into the water sump 54. The water in the water sump 54 is then circulated by the water pump 56 through the inlet portion 65 of the water pump 56, through the outlet portion or port 66 of the water pump 56 and through the water pump line 68 to the inlet port 75 of the four-way water diverter valve 60. The four-way water diverter valve 60 can direct the flow of water or cleaning solution through the outlet portion 76 of the four-way water diverter valve 60 to the drain line 84, the clean water line 90 or the freeze water line 96, and is controlled by the microprocessor or controller 64. During the freeze cycle, however, the water flows from the water pump line 68 through the four-way water diverter valve 60 to the outlet port 82. From there, the water flows through the first end 98 and the second end 100 of the freeze water line 96 to the freeze water inlet 106 of the freeze water portion 102 of the water distribution manifold 62. Such water is then directed through the exit holes 108 of the freeze water portion 102 of the water distribution manifold 62 and cascades down the channels 50 on the first side plate 24 and the channels 52 on the second side plate 26 of the evaporator plate assembly 20 and into the water sump 54. The water will continue to recirculate in this manner until the desired amount of ice has been formed on the evaporator plate assembly 20.

At the beginning of the harvest cycle, the water pump 56 and the dual outlet water inlet valve 58 are again energized. Water from the external water supply (not shown) flows through the second end 132 and the first end 130 of the external water supply line 128 into the inlet port 126 of the dual outlet water inlet valve 58. The water from the external water supply (not shown) then flows through the outlet port 134 of the dual outlet water inlet valve 58 and into the first end 138 of the dual outlet water inlet valve line 120. The water continues to flow through the dual outlet water inlet valve line 120 into the second leg 116 and the first leg 114 of the clean water line 90, and into the harvest water inlet 110 of the harvest water portion 104 of the water distribution manifold 62. Such water is then directed through the exit holes 112 of the harvest water portion 104 of the water distribution manifold 62 and cascades down through the vertical portions 30 of the first side plate 24 and the vertical portions 32 of the second side plate 26 of the evaporator plate assembly 20 and into the water sump 54. The water in the water sump 54 is then pumped by the water pump 56 through the water pump line 68 to the four-way water diverter valve 60. During harvest, the fourway water diverter valve 60 directs all of the water through outlet port 78 into the first end 86 of the drain line 84. Such water is then directed through the second end 88 of the drain line 84 to a drain (not shown) external to the automatic ice making machine 10.

The cleaning cycle is initiated by adding a specified cleaner, commonly known in the industry such as nickel-safe Scotsman® Ice Machine Cleaner into the water sump 54. The microprocessor or controller 64 is then manually manipulated to initiate the cleaning cycle. The microprocessor or controller 64 energizes the water pump 56 so that the cleaning solution is pumped from the water sump 54 through the inlet portion 65 and the outlet portion 66 of the water pump 56 into the water pump line 68 and into the inlet portion 74 of the four-way water diverter valve 60. The four-way water diverter valve 60 will then direct all such cleaning solution through the outlet port 82 and into the freeze water line 96. All such cleaning solution will then flow through the freeze water line 96 into the freeze water inlet 106 of the freeze water portion 102 of the water distribution manifold 62. Thereafter, all such cleaning solution will flow through the exit holes 108 of the freeze water portion 102 of the water distribution manifold 62 and cascade down the channels 50 on the first side plate 24 and the channels 52 on the second side plate 26 of the evaporator plate assembly 20. After a set period of time, the four-way diverter valve 60 will be manually switched and divert all such cleaning solution through the outlet port 80 and into the clean water line 90. Accordingly, all such cleaning solution then flows through the clean water line 90 into the first leg 114 of the second end 94 of the clean water line 90 and into the harvest water inlet 110 of the harvest water portion 104 of the water distribution manifold 62. Thereafter, all such cleaning solution will flow through the exit holes 112 of the harvest water portion 104 of the water distribution manifold 62 and cascade down the vertical portions 30 of the first side plate 24 and the vertical portions 32 of the second side plate 26 of the evaporator plate assembly 20.

The water distribution and cleaning system 22 allows all the cleaning solution to cascade down through the interior surfaces of the evaporator plate assembly 20 for a set period of time and then switches direction, allowing all of the cleaning solution to cascade down the exterior surfaces of the evaporator plate assembly 20. Thereby allowing all of the cleaning solution to be delivered to all of the surfaces of the evaporator plate assembly 20 at a high pressure and velocity. The approved water distribution and cleaning system 22 is capable of supplying the evaporator plate assembly 20 with all the water needed during ice making operations and supplying all exposed surfaces of the evaporator plate assembly 20 with all of the cleaning solution during cleaning operations.

While the above detailed description describes the preferred embodiment of the present invention, it should be understood and appreciated that the invention is susceptible to modification, variation and alteration without departing from the proper scope and fair meaning of the accompanying claims.

What is claimed is:

1. An ice making machine comprising:

an evaporator assembly including (i) a plate having a first side that has a plurality of outwardly extending partitions that are spaced apart to form a plurality of ice forming channels therebetween and (ii) an evaporator tubing disposed on a second opposed side of said plate in thermal communication with said channels;

a fluid source means for supplying a fluid;

a pump in fluid communication with said fluid source means;

a first fluid distributor that is disposed above said evaporator assembly and that is located to supply said fluid to said channels and a second fluid distributor that is disposed above said evaporator assembly and that is located to supply said fluid to said partitions along said first side of said plate; and a valve that is in fluid communication with said pump and that has a first mode in which said fluid supplied by said pump is diverted to said first fluid distributor and a second mode in which said fluid is diverted to said second fluid distributor, whereby said fluid cascades along said channels during said first mode and along said partitions during said second mode.

2. The ice making machine of claim 1, wherein said valve has a third mode in which said fluid supplied by said pump is diverted to a drain.

3. The ice making machine of claim 1, wherein said fluid comprises water and a cleaning solution, and wherein said fluid cleans said channels when said valve is in said first mode and cleans said partitions when said valve in said second mode.

4. The ice making machine of claim 3, wherein said first and second modes occur sequentially.

5. The ice making machine of claim 1, wherein said plate is a first plate, wherein said evaporator includes a second plate that is substantially identical to said first plate, wherein said evaporator tubing is disposed between the second opposed surfaces of said first and second plates, wherein said first fluid distributor is located to supply fluid to the channels of said first plate and to the channels of said second plate, and wherein second fluid distributor is located to supply fluid to the partitions of said first plate and to the partitions of said second plate.

6. The ice making machine of claim 5, wherein said first plurality of partitions are integrally formed in said first plate and said second plurality of partitions are integrally formed in said second plate.

7. The ice making machine of claim 6, further comprising a manifold having a first port in fluid communication with said first fluid distributor and a second port in fluid communication with said second fluid distributor, and wherein said valve diverts said fluid to said first port when in said first mode and to said second port when in said second mode.

8. The ice making machine according to claim 7, further comprising:

a drain line in fluid communication with said valve;

a clean water line in fluid communication with said valve and said second port of said manifold and said dual outlet water inlet valve;

a freeze water line in fluid communication with said valve and said first port of said manifold; and wherein said valve has a third mode in which said fluid supplied by said pump is diverted to said drain line.

9. The ice making machine of claim 8, wherein said fluid source means comprises an external water supply source, a water inlet valve and a sump, wherein said external water supply source supplies water to said sump via said water inlet valve, and wherein said pump is in fluid communication with said sump.

10. The ice making machine of claim 9, wherein said clean water line further comprises a T-shaped portion having a first leg and a second leg, said first leg being operatively in fluid communication with said second port of said manifold and said second leg being operatively in fluid communication with said water inlet valve.

11. The ice making machine of claim 10, wherein the second sides of said first and second plates are secured to said evaporator tubing by a bonding process.

12. The ice making machine of claim 11, wherein said valve diverts said fluid to said freeze line during a freeze cycle and to said drain line during a harvest cycle, wherein said inlet valve diverts water from said external source to said second port during said harvest cycle.

13. A method of cleaning an evaporator assembly of an ice making machine, said evaporator assembly including (i) a plate having a first side that has a plurality of outwardly extending partitions that are spaced apart to form a plurality of ice forming channels therebetween and (ii) an evaporator tubing disposed on a second opposed side of said plate in thermal communication with said channels, said method comprising:

(a) cascading a cleaning fluid down said channels; and (b) cascading said cleaning fluid down said partitions.

14. The method of claim 13, wherein steps (a) and (b) are performed sequentially.

15. The method of claim 14, wherein step (a) applies said cleaning fluid to a first fluid distributor located above said evaporator assembly in a position to cascade said cleaning fluid down said channels, and wherein step (b) applies said cleaning fluid to a second fluid distributor located above said evaporator assembly in a position to cascade said cleaning fluid down said partitions.

* * * * *